US005665198A

United States Patent [19]

Bieber et al.

[11] Patent Number: 5,665,198

[45] Date of Patent: Sep. 9, 1997

[54] SYSTEM FOR ENVELOPE SEALING IN AN INSERTION MACHINE

[75] Inventors: Thomas E. Bieber, Coplay; Jack H. Shaneberger, Bath; Daniel B. Hein, Newtripoli; David M. Skvoretz, N. Catasauqua, all of Pa.

[73] Assignee: Bell & Howell Phillipsburg Company, Allentown, Pa.

[21] Appl. No.: 480,565

[22] Filed: Jun. 7, 1995

[51] Int. Cl.[6] ..... B05C 1/00

[52] U.S. Cl. ..... 156/578; 156/441.5; 156/442.1; 156/442.2

[58] Field of Search ..... 156/578, 441.5, 156/442.1, 442, 442.2

[56] References Cited

U.S. PATENT DOCUMENTS

| | | | |
|---|---|---|---|
| 3,905,325 | 9/1975 | Labore et al. | 156/441.5 X |
| 3,911,862 | 10/1975 | Lupkas | 118/313 X |
| 4,050,361 | 9/1977 | Traise | 156/495 X |
| 4,924,805 | 5/1990 | O'Dea | 156/441.5 X |
| 5,178,715 | 1/1993 | Rehberg | 156/442.1 X |
| 5,242,499 | 9/1993 | Bergman | 156/441.5 X |

*Primary Examiner*—James Engel
*Attorney, Agent, or Firm*—Millen, White, Zelano & Branigan, P.C.

[57] ABSTRACT

An envelope sealer includes a first horizontal plate for receiving an envelope, a vacuum manifold for drawing open the envelope's downward-facing flap as it departs from the first horizontal surface, and a plow for catching the flap and directing it such that the flap travels below a second horizontal plate while the body of the envelope travels above the second horizontal plate. A fiber-optic sensor system is provided for detecting the non-presence of a flap during the travel of the envelope over the second horizontal plate and for actuating a downstream diverter in response thereto. An unseal unseal ramp is provided for lifting the flap over the plow if it is determined that the envelope should not be sealed. During the flap 's travel below the second horizontal plate, it passes and engages a wetted brush, whereby water is applied to the flap's adhesive surface. The flap is then directed upward by a ramp into a closed position, and passes through the nip of a sealer roller which compresses the envelope and flap together to form a seal. A water-contol system applies a precise amount of water to the brush in response to sensing the approach of an envelope's leading edge. The water-control system preferably includes a pressurized water tank, a water-pressure-regulator means, a water solenoid valve, a leading edge sensor, and circuit means. In response to sensing the approach of an envelope's leading edge, the circuit means causes the water solenoid valve to release a precise amount of water from the pressurized water tank to the brush. A water storage tank, pump means, and water pressure sensor cooperate with the circuit means to maintain the water pressure in the pressurized water tank within predetermined upper and lower limits.

8 Claims, 5 Drawing Sheets

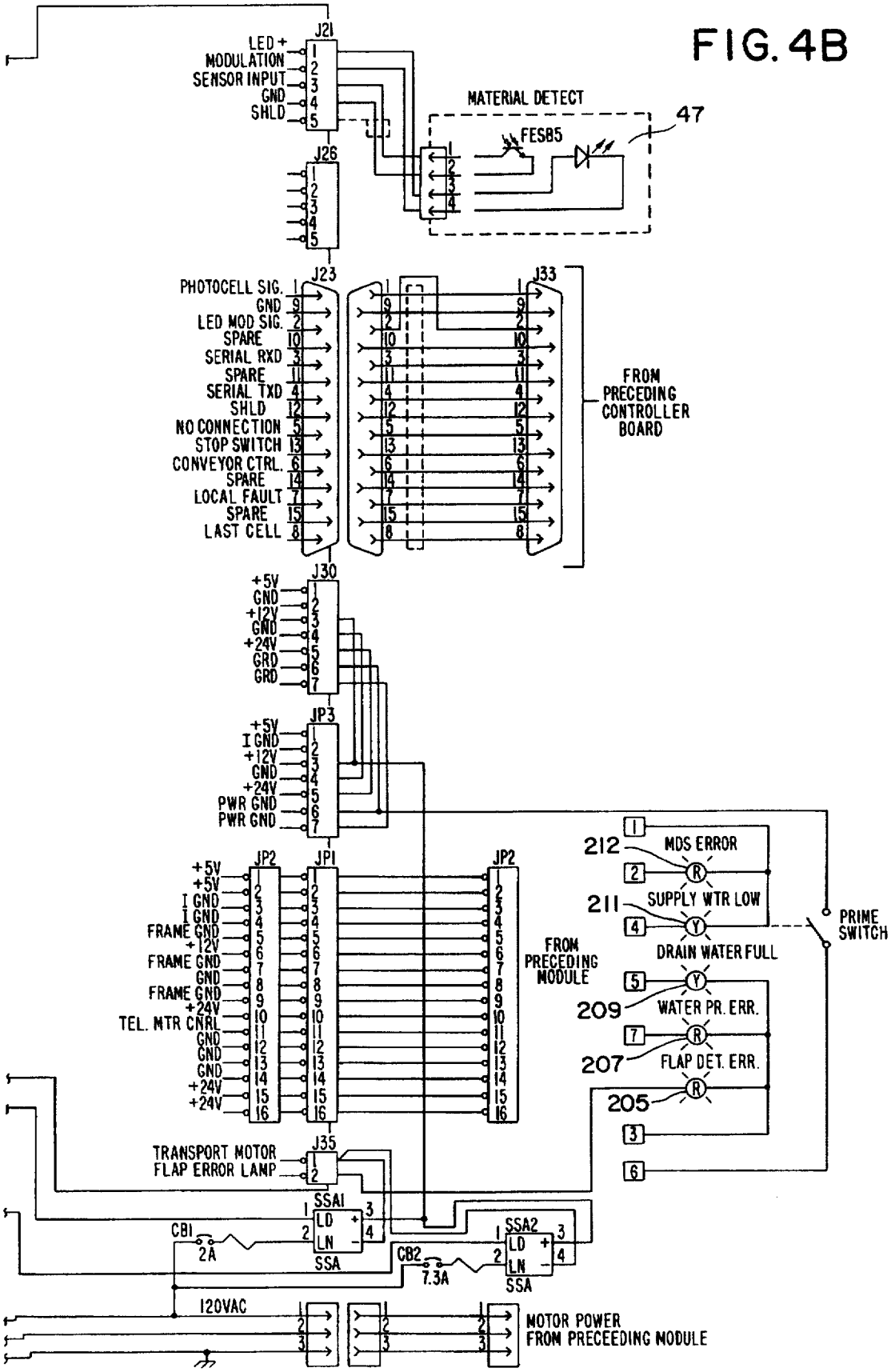
FIG. 4B
J21
LED +
MODULATION
SENSOR INPUT
GND
SHLD
MATERIAL DETECT
FES85
47
J26
J23
PHOTOCELL SIG.
GND
LED MOD SIG.
SPARE
SERIAL RXD
SPARE
SERIAL TXD
SHLD
NO CONNECTION
STOP SWITCH
CONVEYOR CTRL.
SPARE
LOCAL FAULT
SPARE
LAST CELL
J33
FROM PRECEDING CONTROLLER BOARD
J30
+5V
GND
+12V
GND
+24V
GRD
GRD
JP3
+5V
I GND
+12V
GND
+24V
PWR GND
PWR GND
JP2
JP1
+5V
+5V
I GND
I GND
FRAME GND
+12V
FRAME GND
GND
FRAME GND
+24V
TEL. MTR CNRL
GND
GND
GND
+24V
+24V
FROM PRECEDING MODULE
212
MDS ERROR
211
SUPPLY WTR LOW
PRIME SWITCH
DRAIN WATER FULL
209
WATER PR. ERR.
207
FLAP DET. ERR.
205
J35
TRANSPORT MOTOR
FLAP ERROR LAMP
SSA1
LD
LN
SSA
CB1
2A
CB2
7.3A
SSA2
120VAC
MOTOR POWER FROM PRECEEDING MODULE

SYSTEM FOR ENVELOPE SEALING IN AN INSERTION MACHINE

BACKGROUND OF THE INVENTION

1. Field of the Invention

The invention relates in general to insertion machines for bulk assembly of mail pieces, and in particular to a system for sealing envelopes as they are transported along a conveyor.

2. Related Art

Sealers have been known for use in mail-processing machines, such as insertion machines, for wetting and sealing an envelope flap after the envelope has been stuffed with inserts by upstream insertion stations. Sealers of the prior art have generally included flap-wetting systems which operate to apply an inconsistent and/or imprecise amount of water to the flaps of envelopes travelling therethrough, resulting in such undesireable effects as over-wetting of the flap, which may cause the flap to curl and become jammed in the machine transport, and under-wetting of the flap, which may cause unintentional non-sealing of the flap. If, for example, the machine as a whole slows from a surface transport speed of 75 inches-per-second to 25 inches-per-second, undesireable results, such as over-wetting of an envelope, may occur.

Sealers and insertion stations have often been made integral in a single machine, such that the sealer relies on machine-wide resources such as transport motors, timing mechanisms, transport mechanisms, power supplies, etc. However, this integration yields a sealer which does not operate independently, resulting in inconsistent sealing operations.

OBJECTS AND SUMMARY

It is therefore an object of the invention to provide an improved envelope flap-sealer.

It is a further object of the invention to provide an envelope flap sealer which provides improved consistency, accuracy, and control over water-application to an envelope's flap.

It is a further object of the invention to provide a sealer module which operates with increased independence.

In a preferred embodiment, the invention provides an envelope sealer having a first horizontal plate for receiving an envelope, a vacuum manifold for drawing open the envelope's downward-facing flap as it departs from the first horizontal plate, and a plow for catching the flap and directing it such that the flap travels below a second horizontal plate while the body of the envelope travels above the second horizontal plate. A fiber-optic sensor system is provided for detecting the non-presence of a flap during the travel of the envelope over the second horizontal plate and for actuating a downstream diverter in response thereto. An unseal ramp is provided for lifting the flap over the plow if it is determined that the envelope should not be sealed.

During the flap's travel below the second horizontal plate, it passes and engages a wetted brush, whereby water is applied to the flap's adhesive surface. The flap is then directed upward by a ramp into a closed position, and passes through the nip of a sealer roller which compresses the envelope and flap together to form a seal. A water-contol system applies a precise mount of water to the brash in response to sensing the approach of an envelope's leading edge. The water-control system preferably includes a pressurized water tank, a water-pressure-regulator means, a water solenoid valve, a leading edge sensor, and circuit means. In response to sensing the approach of an envelope's leading edge, the circuit means causes the water solenoid valve to release a precise amount of water from the pressurized water tank to the brush. A water storage tank, pump means, and water pressure sensor maintain the water pressure in the pressurized water tank within predetermined upper and lower limits.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION

Figure 1:
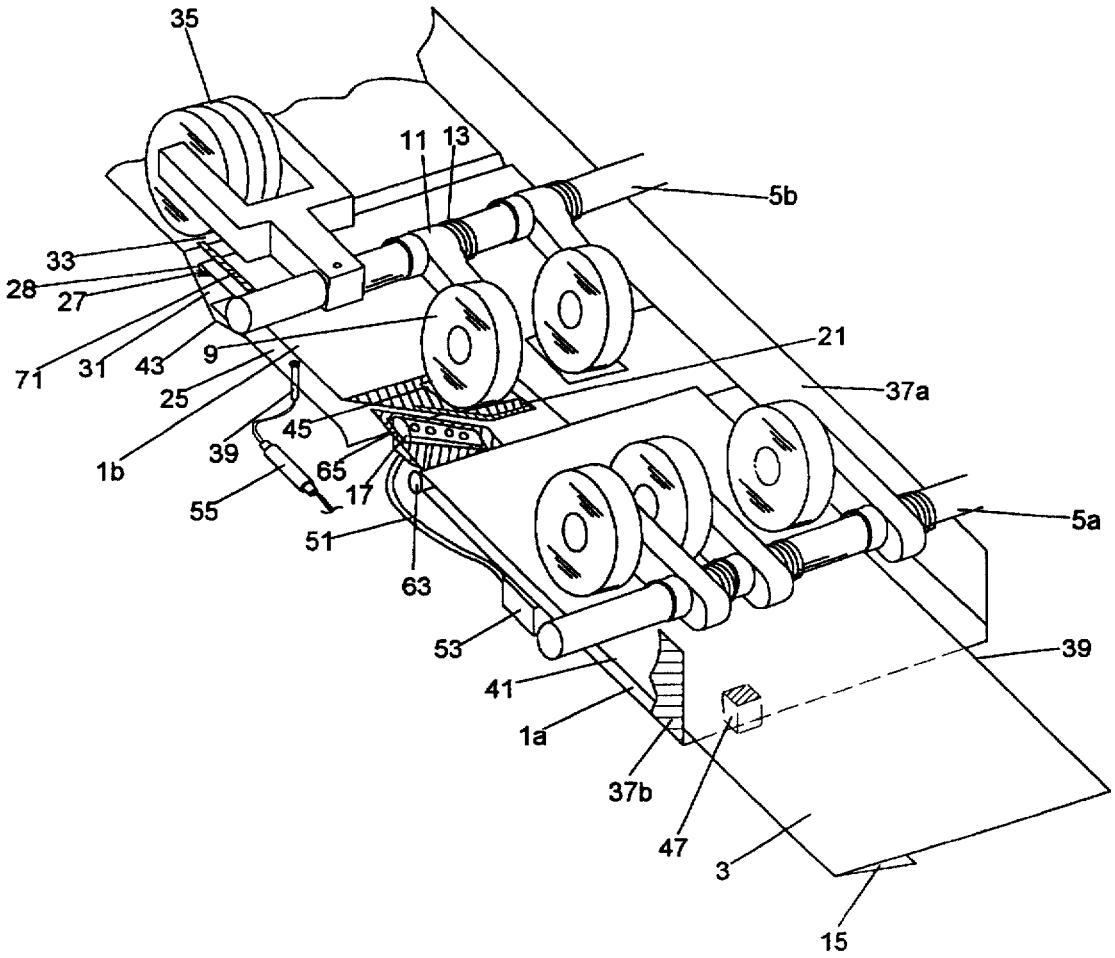
FIG. 1 is a schematic perspective view which illustrates certain features of the envelope sealer system of the invention according to a preferred embodiment.

With reference to FIG. 1, the sealer module of the invention in its preferred embodiment includes a first horizontal plate 1*a* for receiving and supporting a mailpiece 3 from an upstream portion, such as a turnover, insertion station, or other known mailpiece-processing station. First and second cross-members 5*a*, 5*b* support roller arms 11, which are rotatably mounted thereto and biased downward by coil springs 13. Idler rollers are mounted to the roller arms 11 and form a nip with driven feed rollers mounted below the surface of the horizontal plate 1*a*.

First and second vertical guide angles 37*a*, 37*b* guide the mail piece 3 by engaging first and second edges 39, 41 of the mail piece as it travels across the first plate 1*a* and a second plate 1*b*. The vertical guide angles 37*a*, 37*b* serve to minimize envelope skew and flap roll. The vertical guide angle 37*a* is preferably slidably adjustable in a direction perpendicular to the feed direction for purposes of accomodating mail pieces of various widths. It should be noted that the first and second horizontal plates may comprise a single integral plate, since both are preferably at the same height.

A vacuum manifold 17 is provided below and between the first and second horizontal plates 1*a*, 1*b*. The vacuum manifold 17 preferably comprises a hollow casing having four 1/16" diameter perforations through its upper surface. The vacuum manifold 17 is connected via a vacuum hose 51 to a vacuum pump 53 for producing suction through the perforations.

A generally triangular plow 21 is provided between the first horizontal plate 1*a* and the second horizontal plate 1*b*. The plow 21 preferably includes an upwardly flanged forward edge, and a rectangular cut-out 45 for accepting a lower feed roller, which forms a nip with the upper feed roller 9. The plow is preferably adjustable in a direction toward or away from the hinge line of envelopes travelling thereover to accomodate different types and/or thicknesses of envelopes.

A module input sensor 47 is provided for sensing the leading edge of an incoming document and signalling downstream devices, such as the water solenoid, discussed below with reference to FIG. 4. The module input sensor 47 is preferably a modulated, reflective type photocell. The mail piece 3 enters the sealer face-up, right-hand edge leading. As the leading edge of the mail piece approaches the nip formed by idler roller 9 and a lower, driven feed roller, its flap 15, which faces downward, is drawn open slightly by suction from the vacuum manifold 17. This causes the flap 15 to be below the surface of the plow 21 such that, as the mail piece 3 travels over the plow 21 and onto the second horizontal plate **1*b*, its flap 15 travels under the plow 21 and under the plate 1*b*. An adjustable tension hold-down rod may be mounted to the cross member 5*a* for riding on top of the envelope, pressing it (and the flap) downward against the plow 21**.

If an operator or an upstream mail-processing module sends a signal indicating that a particular mail piece or series of mail pieces should not be sealed, an unseal solenoid 63 is energized upon detection of an incoming mail piece at the module input sensor 47. Actuation of the unseal solenoid 63 causes an unseal ramp 65 to be lifted. When the unseal ramp 65 is in the raised position, it causes the envelope flap to travel over the plow 21 and above the surface of the second horizontal plate **1*b***, thus effectively bypassing the downstream flap-wetting step discussed below.

A lower horizontal plate 25 is provided below the second horizontal plate **1*b* such that a gap is provided between the second horizontal plate 1*b* and the lower horizontal plate 25. A brush 27 is provided along a downstream edge of the second horizontal plate 1*b*. A pulsed stream of water is delivered to the brush 27 via a brass orifice 28, which is a flattened brass tube having perforations thereon. The pulsed stream of water is supplied to the brass orifice 28 by a water solenoid, described below. Assuming that the flap 15 is to be sealed, and not left unsealed, it travels through the gap between the lower horizontal plate 25 and the second horizontal plate 1*b* and passes the downstream edge of the second horizontal plate 1*b*. As it does so, its adhesive surface contacts the wetted brush 27, whereby a precise amount of water is applied to the adhesive surface. Excess water from the brush 27 drops out into a trough 43, which includes a drain for draining off the water into a receptacle. To prevent the flap from riding up or rolling due to the brush pressure (especially on thicker envelopes), an anti-roll rod 71** is provided for pressing down on the top edge of the envelope as the flap exits the brush.

As the flap 15 continues past the downstream edge of the second horizontal plate **1*b*, it engages a ramp 31 and is directed upwardly into a closed position. As the flap 15 closes, the envolope and closed portion of the flap enter a nip 33 of a first sealer roll 35. The sealer roll 35 serves to compress the wetted flap against the broad back surface of the mail piece, creating a seal. A second sealer roll may be provided downstream from the first sealer roll 35 for reinforcing the seal and/or sealing portions of the flap which were not compressed by the first sealer roll 35**. The sealer rolls are preferably constructed of compressible foam to adapt to envelopes which are of various thicknesses and are unevenly stuffed.

A fiber-optic sensor 39 is provided for sensing the presence/non-presence of a flap 15 and for actuating a downstream diverter upon sensing non-presence of a flap during travel of a mail piece over the second horizontal plate **1*b*. The fiber-optic sensor 39 is connected by leads to a fiber-optic amplifier 55**, which is in-turn connected to circuitry described below for making the presence/non-presence determination and actuating a downstream diverter accordingly.

Figure 2:
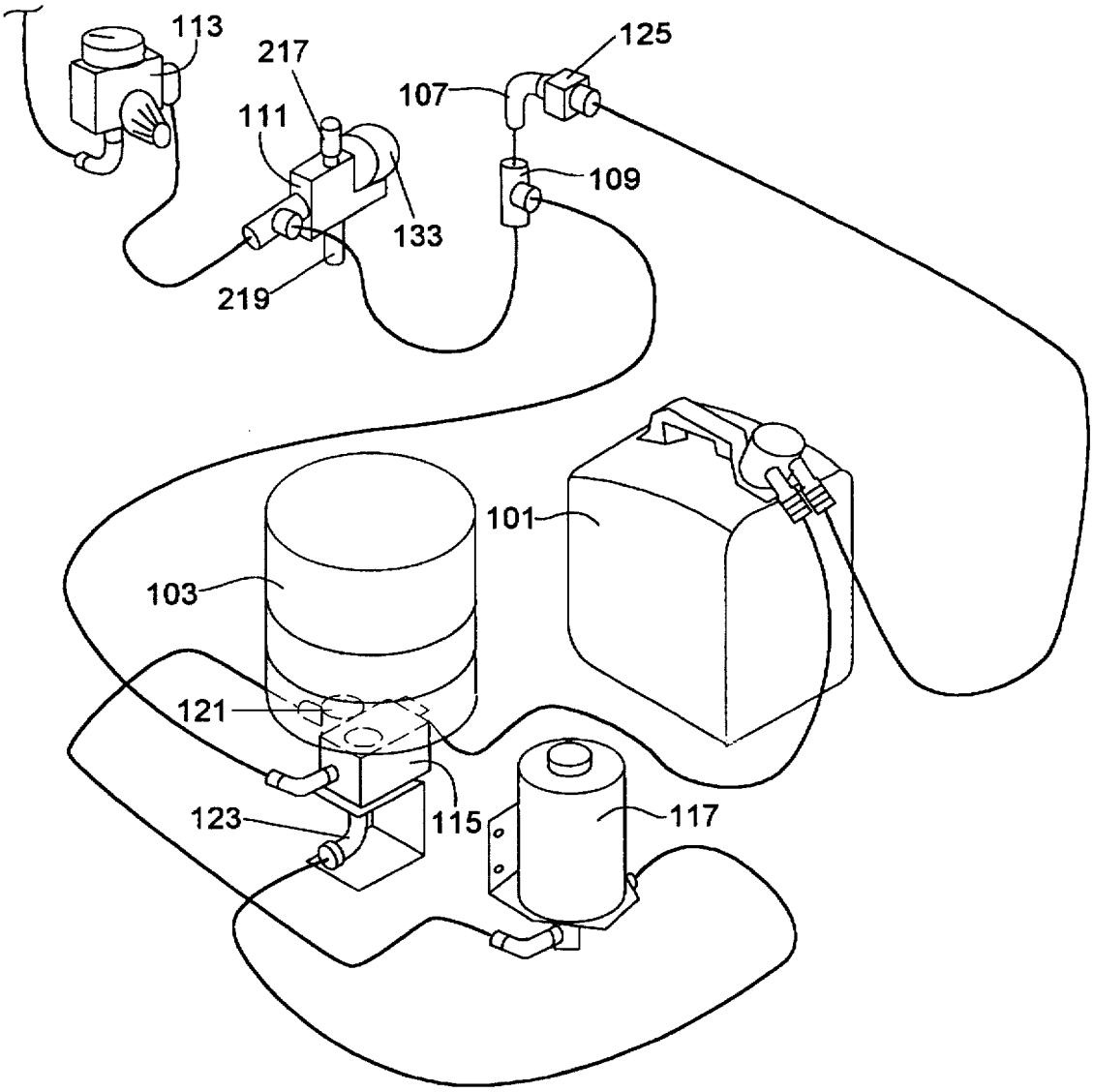
FIG. 2 is a schematic perspective view which illustrates a water-contol system of the invention according to a preferred embodiment.

FIG. 2 illustrates the water-application system of the invention according to a preferred embodiment. Water is pumped from a bottle 101 through a tank fitting 115 and into a filter 121. From the filter, the water enters a water pump 117 on its low-pressure side and exits the pump on its high-pressure side. The water then enters a 90-degree fitting 123 on the bottom of the tank fitting 115 and gets pumped into a charged water tank 103. The water is now under pressure. The pump 117 includes differential switches which can be set for low and high pressure limits so as to activate the pump when the pressure drops below a low limit and deactivate the pump when the pressure reaches the high limit. The low limit is preferably 45 PSI and the high limit is preferably 60 PSI. In this manner, the pressure level in the charged tank is regulated between 45 and 65 PSI, thereby ensuring that a consistent mount of water is applied to the brush by the water solenoid 201 with each pulse, without the requirement of a continuously-running pump.

The water exits the tank fitting 115 and proceeds to a T-fitting 109. One side of the T-fitting 109 is connected to a purge valve 125. If the purge valve 125 is open, water exits the valve and is fed back into the bottle 101. Purging the air from the water system is desireable whenever the water cabinet is initially pressurized or after a fresh supply of water is loaded.

The second side of the T-fitting 109 is connected to a T-valve which is mounted on one side to a gauge mount 111. The gauge mount 111 is fitted with a system pressure gauge 133, a low-pressure switch 217, and a high-pressure switch 219. The functions of these switches will be discussed below with reference to FIG. 4. The second side of the T-valve is connected to the input of a brush-pressure regulator 113, which is in-turn connected to a water solenoid 201 (FIG.4). The regulator 113 includes a gauge to indicate the mount of water pressure to the water solenoid and a knob for adjusting water pressure to the water solenoid. A pressure to the water solenoid of, e.g., 5 PSI is preferable.

Figure 3:
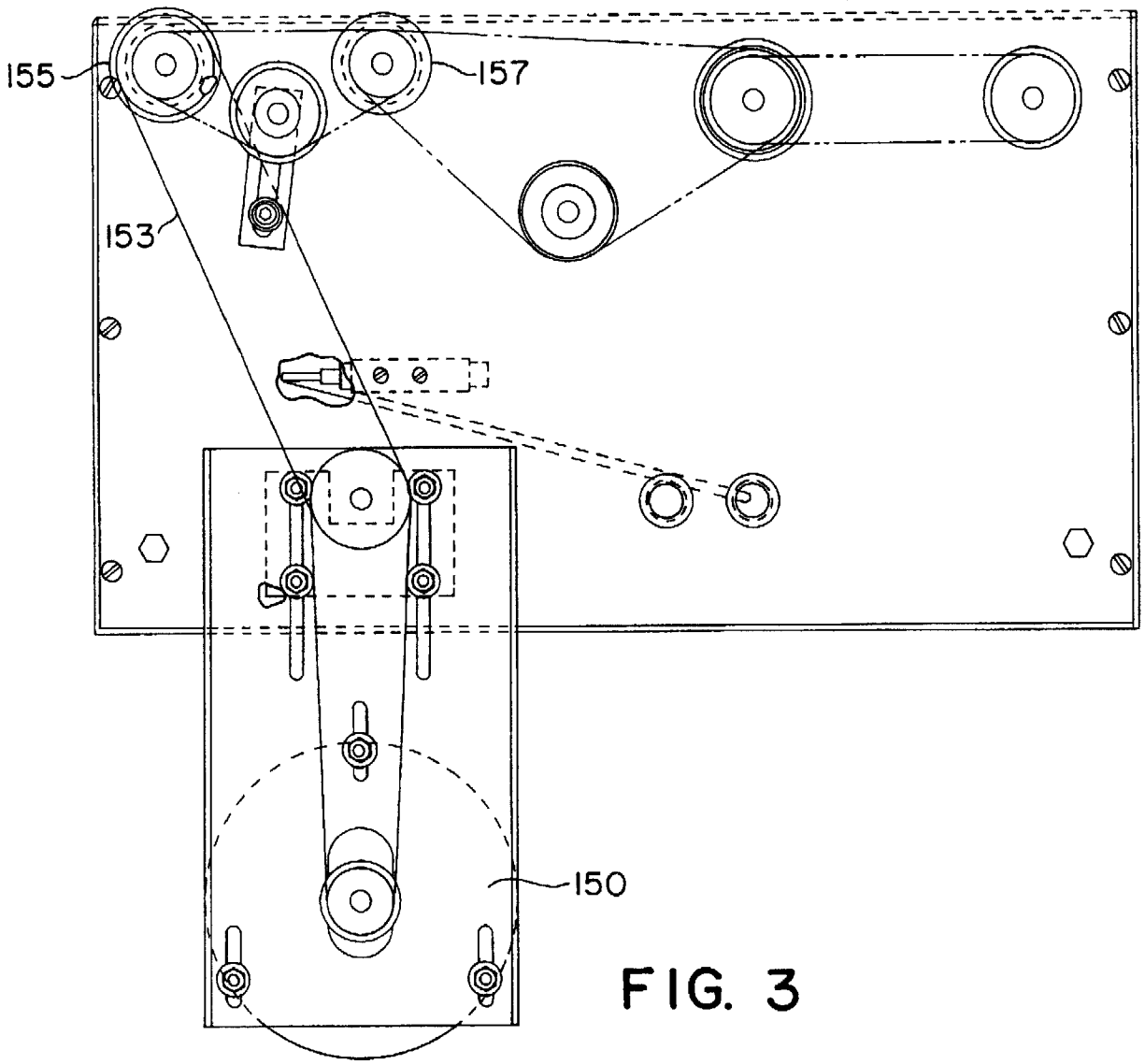
FIG. 3 illustrates a schematic side view of transport portions of the sealer according to the invention.

FIG. 3 illustrates a schematic side view of the drive portions of the invention. A 1/10 hp AC transport motor 150 drives a series of shafts through timing belts and pullleys. Lower drive rollers 155, 157 are driven via the shafts and form a nip with upper idler rollers (FIG. 1). The transport motor 150 is driven at a speed which results in mail pieces being driven through the nip at, e.g., 75 inches-per-second.

Figure 4A:
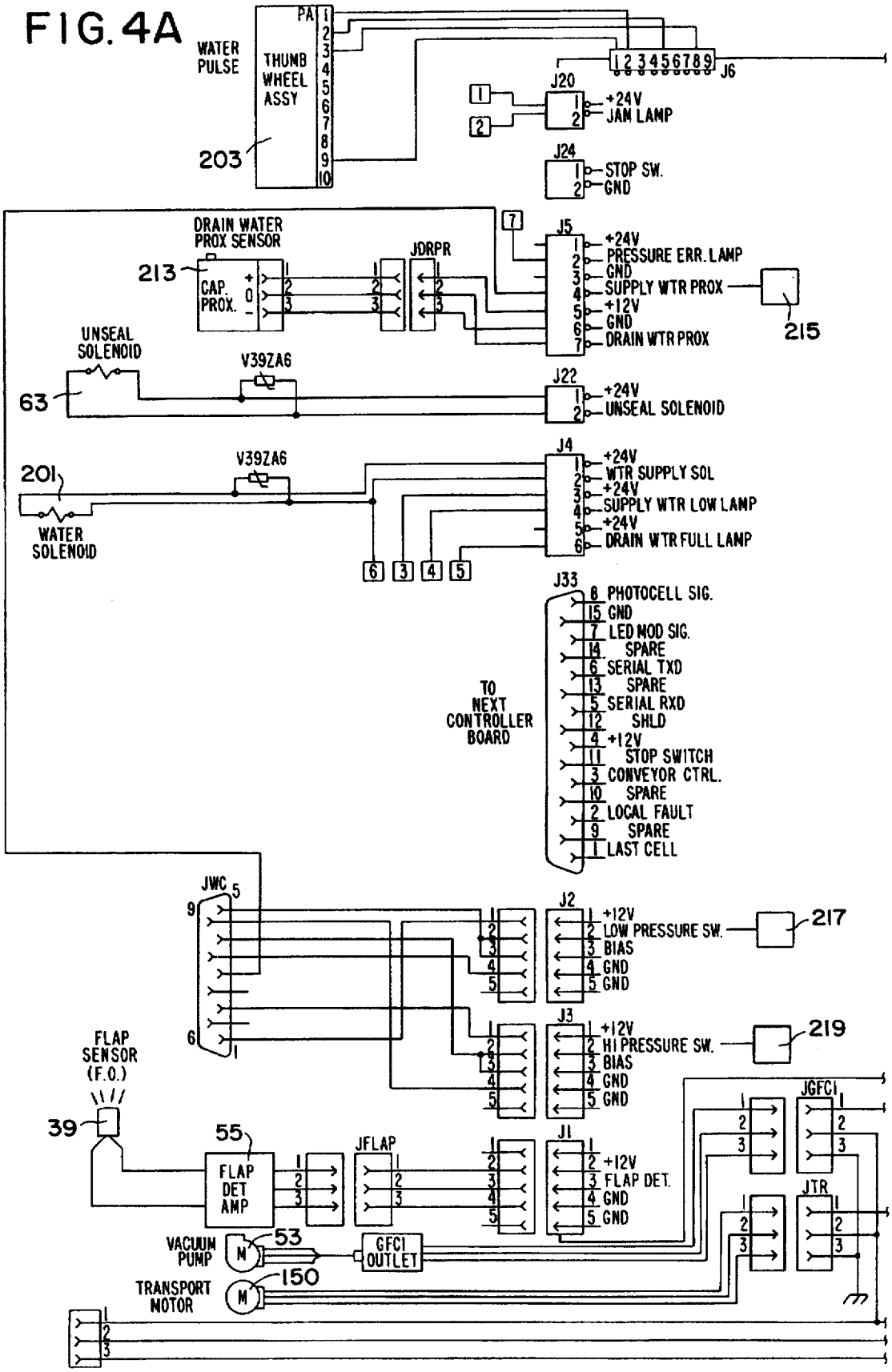
FIG. 4 is a schematic representation of electrical potions of sealer according to the invention.

FIG. 4 illustrates electrical portions of the sealer module according to the invention. The logic and timing functions of the sealer are controlled by a slave controller board and a slave expander controller board, generally denoted in the figure by the words "Slave Controller Boards." The slave expander is built around the 80c31 microprocessor and communicates to the slave via a 40-pin ribbon cable. The slave controller boards receive a signal from the module input sensor 47 indicating entry into the module of a mail piece and, unless an instruction is received (e.g., from a preceding module or from an operator-actuated switch) indicating that the incoming mail piece is not to be sealed, actuate the water solenoid 201 to provide a pulse of water to the brush. A water-pulse-length thumb wheel assembly 203 provides the operator with a means for free control of the amount of water which is delivered by the water solenoid 201 by varying the time-length of the water pulse. The water-pulse-length thumbwheel is preferably set so that a minimum setting provides a 30-millisecond pulse pulse. A prim setting provides a 100-millisecond pulse. A prime switch may be provided for causing the water-solenoid to pulse when the brush is dry. The prime switch can be activated automatically upon machine power-up and automatically every hour that the machine is powered up and is not in operation.

If a signal is not received by the slave controller boards from the fiber optic sensor 39 within a specified mount of time after detection of the incoming mail piece, a flap detect error signal is generated. The flap detect error signal can be used, e.g., to enable a flap detect error lamp 205 or a downstream diverter. An MDS error lamp 212 is caused to be lit if the control logic in the slave controller boards detects an error and shuts down the system.

A drainwater proximity sensor 213 is attached to a drainwater bottle, which receives excess water from the brash. When the drainwater reaches a predetermined high level within the bottle, the proximity sensor 213 sends a signal to the slave controller boards, which in-turn actuate a drainwater full lamp 209. In a like manner, a supply water proximity sensor 215 is attached to the water bottle 101 (FIG. 2); when the supply water reaches a predetermined low level, the slave controller boards receive a signal from the supply water proximity sensor 215, and in-turn actuate a supply water low lamp 211.

A low-pressure switch 219 and a high-pressure switch 217 are associated with the gauge 111 (FIG. 2). When low pressure in the charged tank is detected, the low-pressure switch is activated and a signal is sent to the slave controller boards. The pressure required to activate the low-pressure switch is, e.g., 32 PSI. The slave controller boards in turn activate a water-pressure error lamp 207. Likewise, if a high-pressure level of 86 is detected, the high-pressure switch 217 is activated, sending a signal to the slave controller boards. The boards then activate the water-pressure error lamp 207 and cut power to the pump.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A sealer system for wetting and sealing flap portions of mail pieces, comprising:

horizontal surface means for receiving a mail piece;

transport means for transporting said mail piece along said horizontal surface means;

means for drawing open a flap portion of said mail piece;

fluid-application means for applying a predetermined amount of fluid to said flap of said envelope, said fluid-application means comprising:

fluid storage means for storing fluid, said fluid storage means comprising:

at least one pressurized tank means;

pump means for pumping said water into said pressurized tank means;

means for sensing a low-pressure limit and for actuating said pump means in response thereto;

means for sensing a high-pressure limit and for de-actuating said pump means in response thereto;

means for delivering said fluid at an elevated pressure to a solenoid valve means;

mail piece detector means for detecting the approach of said mail piece and for generating a detection signal in response thereto;

means for opening said valve in response to said detection signal and for closing said solenoid valve after a predetermined period of time;

brush means for delivering said fluid from said solenoid valve means to said flap portion of said mail piece: and, means for closing said flap portion.

2. The sealer system according to claim 1, wherein said means for delivering said fluid comprises a brush for receiving said fluid and for contacting said flap portion, whereby said flap portion becomes wetted.

3. The sealer system according to claim 1, further comprising:

an unseal ramp means movable between a first position which permits said flap to be wetted and a second position which prevents said flap from being wetted;

actuator means for selectively moving said unseal ramp between said first position and said second position.

4. The sealer system according to claim 1, wherein said means for sensing a low pressure limit comprises a first differential switch associated with said pump and wherein said means for sensing a high pressure limit comprises a second differential switch associated with said pump.

5. A sealer system for wetting and sealing flap portions of mail pieces and for selectively bypassing said wetting and sealing, comprising:

first surface means for receiving mail pieces on a first side thereof;

transport means for transporting said mail pieces along said first surface means;

second surface means adjacent to a side opposite said first side of said first surface means, generally parallel to said first surface means and separated therefrom by a gap;

means for drawing open flap portions of said mail pieces;

means for selectively engaging and directing said flap portions into said gap between said first and second surface means;

fluid-application means for applying fluid to flap portions which have been directed into said gap; and, means for closing said flap portion.

6. The sealer system according to claim 5, wherein said for means for selectively engaging and directing said flap portions into said gap comprises:

plow means for engaging a first one of said flap portions and for directing same into said gap; and, unseal ramp means selectively actuatable for engaging a second one of said flap portions and for causing said second one of said flap portions to bypass said plow means, whereby said second one of said flap portions is not directed into said gap.

7. The sealer system according to claim 6, further comprising a vacuum means for initially opening said first one of said flap portions prior to engagement by said plow means.

8. A sealer system for wetting and sealing flap portions of mail pieces, comprising:

horizontal surface means for receiving a mail piece;

transport means for transporting said mail piece along said horizontal surface means;

means for drawing open a flap portion of said mail piece;

fluid-application means for applying a predetermined amount of fluid to said flap of said envelope, said fluid-application means comprising:

fluid storage means for storing fluid, said fluid storage means comprising:

at least one pressurized tank means;

pump means for pumping said water into said pressurized tank means;

means for sensing a low-pressure limit and for actuating said pump means in response thereto;

means for sensing a high-pressure limit and for de-actuating said pump means in response thereto;

means for delivering said fluid at an elevated pressure to a solenoid valve means;

mail piece detector means for detecting the approach of said mail piece and for generating a detection signal in response thereto;

means for opening said valve in response to said detection signal and for closing said solenoid valve after a predetermined period of time;

means for delivering said fluid from said solenoid valve means to said flap portion of said mail piece;

means for closing said flap portion;

flap detector means for detecting whether said flap portion has been opened; and, error-signal-generation means for generating an error signal if said flap portion has not been detected by said flap detector means within a predetermined period of time after detection of said mail piece by said mail piece detector means.

* * * * *